US010824105B2

(12) United States Patent
Nakai et al.

(10) Patent No.: US 10,824,105 B2
(45) Date of Patent: Nov. 3, 2020

(54) IMAGE FORMING APPARATUS HAVING A CONTROL OF TRANSFER VOLTAGE

(71) Applicant: CANON KABUSHIKI KAISHA, Tokyo (JP)

(72) Inventors: Tomoaki Nakai, Numazu (JP); Yusaku Iwasawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/906,132

(22) Filed: Feb. 27, 2018

(65) Prior Publication Data

US 2018/0253051 A1 Sep. 6, 2018

(30) Foreign Application Priority Data

Mar. 3, 2017 (JP) ..... 2017-041005

(51) Int. Cl.
*G03G 15/00* (2006.01)
*G03G 15/16* (2006.01)
*G03G 21/20* (2006.01)

(52) U.S. Cl.
CPC ..... *G03G 15/5062* (2013.01); *G03G 15/161* (2013.01); *G03G 21/20* (2013.01); *G03G 2215/1661* (2013.01)

(58) Field of Classification Search
None
See application file for complete search history.

(56) References Cited

U.S. PATENT DOCUMENTS 8,488,985 B2 7/2013 Miura
8,837,972 B2 9/2014 Nakade
2011/0229820 A1* 9/2011 Higa ..... G03G 15/0848 430/125.3
2015/0117888 A1* 4/2015 Wakamatsu ..... G03G 15/5004 399/71
2018/0107906 A1* 4/2018 Shimizu ..... G03G 15/50

FOREIGN PATENT DOCUMENTS

JP 2000-075694 A 3/2000
JP 2010-032950 A 2/2010
JP 2011123521 A * 6/2011
JP 2011123521 A * 6/2011
JP 2012185320 A * 9/2012
JP 2012185320 A * 9/2012
JP 2013-033137 A 2/2013

OTHER PUBLICATIONS

JP_2011123521_A_T Machine Translstion, Japan, Tsunoda, 2011.*
JP_2012185320_A_T Machine Translation, Kaida, Japan, 2012.*

* cited by examiner

*Primary Examiner* — Victor Verbitsky
(74) *Attorney, Agent, or Firm* — Venable LLP

(57) ABSTRACT

The image forming apparatus includes an image bearing member, a charge member, a transfer unit, an application unit, a cleaning member, a detection unit that detects an index value, and a control unit that, in a case where one or a plurality of consecutive toner images for which the index value is equal to or greater than a first threshold value is formed, performs control which increases an absolute value of the transfer voltage for a toner image to be formed next, and in a case where one or a plurality of consecutive toner images for which the index value is less than a second threshold value equal to or greater than the first threshold value is formed, performs control which decreases an absolute value of the transfer voltage for a toner image to be formed next.

20 Claims, 7 Drawing Sheets

IMAGE FORMING APPARATUS HAVING A CONTROL OF TRANSFER VOLTAGE

BACKGROUND OF THE INVENTION

Field of the Invention

The present invention relates to an image forming apparatus such as a copier, a printer or a facsimile machine that uses an electrophotographic method or an electrostatic recording method.

Description of the Related Art

Conventionally, for example, in image forming apparatuses that use an electrophotographic method, a photosensitive member (electrophotographic photosensitive member) as an image bearing member is charged, and the charged photosensitive member is exposed according to image information to thereby form an electrostatic latent image on the photosensitive member. Toner is supplied to the electrostatic latent image formed on the photosensitive member to thereby develop the electrostatic latent image as a toner image. The toner image is transferred onto a transfer material such as paper directly or is transferred onto the transfer material after being temporarily transferred onto an intermediate transfer member. Residual toner that remains on the photosensitive member after the transfer process is removed from the photosensitive member by a cleaning member and collected. The process for charging the photosensitive member is performed, for example, by applying a charging bias voltage (hereunder, referred to as "charging voltage") to a charge member that is disposed in contact with the photosensitive member. Further, the transfer of a toner image from an image bearing member to a transferred member such as a transfer material or an intermediate transfer member is performed, for example, by applying a transfer bias voltage (hereunder, referred to as "transfer voltage") to a transfer member that is disposed facing the image bearing member with the transferred member interposed therebetween. A cleaning blade (herein, also referred to simply as a "blade") that is disposed in contact with the photosensitive member and scrapes off adhered material from the surface of the rotating photosensitive member is widely used as a cleaning member. The blade is generally disposed so that the longitudinal direction thereof is substantially parallel to the rotation axis direction of the photosensitive member, and an edge part of a free end that is one of the ends in the short-side direction is caused to contact against the photosensitive member.

Japanese Patent Application Laid-Open No. 2000-075694 discloses a method that detects (or predicts) fluctuations in the electric resistance value of a transfer-voltage transfer member or an intermediate transfer member, and controls a transfer voltage according to the result of the detection (or prediction). That is, at a non-image forming time, a transfer voltage that is subjected to constant-current control to a previously set value is applied to the transfer unit, and a generated voltage at such time is detected. At an image forming time, image forming is performed based on the detected generated voltage or a voltage value determined by means of arithmetic processing that is based on the aforementioned generated voltage.

However, in the conventional transfer voltage control as described above, because the transfer voltage is optimized by focusing substantially on only the transfer properties, the following problem exists. That is, particularly in a case where images that have a low page coverage (hereunder, referred to as "printing rate") are formed consecutively, a charge member that is disposed in contact with a photosensitive member may become smeared, and image defects may arise due to charging defects (charging unevenness) on the photosensitive member. Smearing of the charge member is dependent on the transfer voltage, and there is a tendency for the smearing to worsen as the absolute value of the transfer voltage increases, and to improve as the absolute value of the transfer voltage decreases.

SUMMARY OF THE INVENTION

One aspect of the present invention is an image forming apparatus that can suppress smearing of a charge member while suppressing a decline in transfer properties.

Another aspect of the present invention is an image forming apparatus including an image bearing member configured to bear a toner image, a charge member configured to contact the image bearing member and charge the image bearing member, a transfer unit configured to transfer a toner image to be transferred from the image bearing member to a transferred member, an application unit configured to apply a transfer voltage for transferring a toner image from the image bearing member to the transferred member, to the transfer unit, a cleaning member configured to contact the image bearing member and remove toner on the image bearing member from the image bearing member, a detection unit configured to detect an index value which correlates with a toner amount of each of toner images transferred to one sheet of the transfer material, a memory unit configured to revise a variable according to the index value and store the revised variable, the memory unit configured to change the variable in a first direction and store the changed variable in a case where the index value is equal to or greater than a first threshold value, the first direction being one of an increase direction and a decrease direction, and change the variable in a second direction and store the changed variable in a case where the index value is less than a second threshold value which is less than or equal to the first threshold value, the second direction being opposite to the first direction among the increase direction and the decrease direction, and a control unit configured to perform control to increase an absolute value of the transfer voltage for a toner image to be formed next in a case where the variable is changed in the first direction, and to decrease an absolute value of the transfer voltage for a toner image to be formed next in a case where the variable is changed in the second direction.

A further aspect of the present invention is an image forming apparatus including an image bearing member configured to bear a toner image, a charge member configured to contact the image bearing member and charge the image bearing member, a transfer unit configured to transfer a toner image to be transferred from the image bearing member to a transferred member, an application unit configured to apply a transfer voltage for transferring a toner image from the image bearing member to the transferred member, to the transfer unit, a cleaning member configured to contact the image bearing member and remove toner on the image bearing member from the image bearing member, a detection unit configured to detect an index value which correlates with a toner amount of each of toner images transferred to one sheet of the transfer material, and a control unit configured to perform control which increases an absolute value of the transfer voltage for a toner image to be formed next in a case where one or a plurality of consecutive toner images for which the index value is equal to or greater than a first threshold value is formed, and perform control which decreases an absolute value of the transfer voltage for a toner image to be formed next in a case where one or a plurality of consecutive toner images for which the index value is less than a second threshold value that is equal to or less than the first threshold value is formed.

A further aspect of the present invention is an image forming apparatus including an image bearing member configured to bear a toner image, a charge member configured to contact the image bearing member and charge the image bearing member, a transfer unit configured to transfer a toner image to be transferred from the image bearing member to a transferred member, an application unit configured to apply a transfer voltage for transferring a toner image from the image bearing member to the transferred member, to the transfer unit, a cleaning member configured to contact the image bearing member and remove toner on the image bearing member from the image bearing member, a detection unit configured to detect an index value which correlates with a toner amount of each of toner images transferred to one sheet of the transfer material, and a control unit configured to perform a constant voltage control with a transfer voltage applied to the transfer unit from the application unit as a constant voltage in a case where a toner image is transferred from the image bearing member to a transferred member, wherein the control unit changes between a case of adding a correction voltage to the transfer voltage set in the constant voltage control and a case of subtracting a correction voltage from the transfer voltage set in the constant voltage control, based on the index value detected by the detection unit.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Hereunder, the image forming apparatus according to the present invention is described in further detail with reference to the accompanying drawings.

Embodiment 1

1. Overall Configuration and Operations of Image Forming Apparatus

Figure 1:
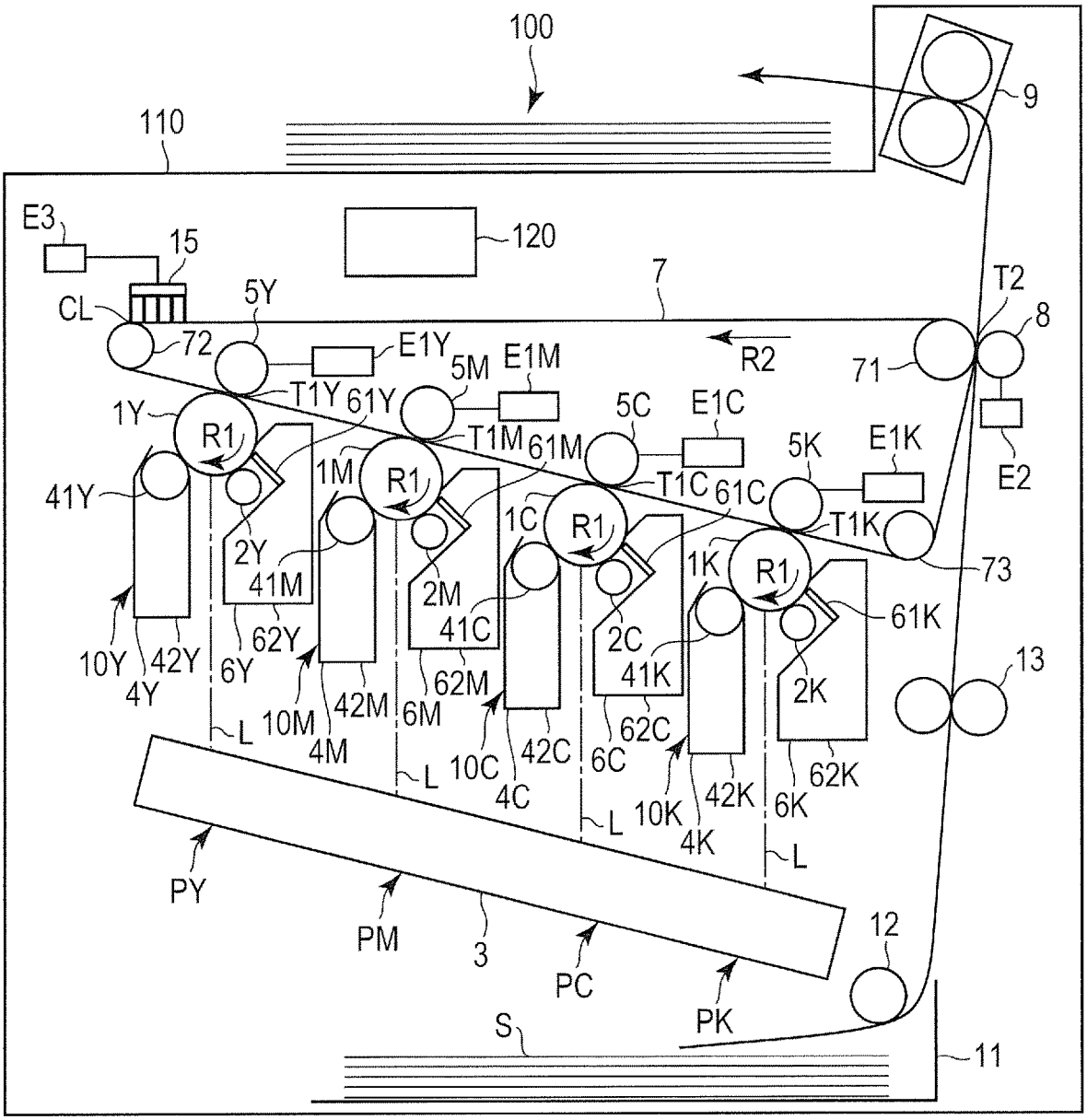
FIG. 1 is a schematic longitudinal sectional drawing of an image forming apparatus.

FIG. 1 is a schematic cross-sectional view of an image forming apparatus 100 according to the present embodiment. The image forming apparatus 100 of the present embodiment is an in-line type (tandem type) laser beam printer that adopts an intermediate transfer method and that can form a full-color image using an electrophotographic method.

The image forming apparatus 100 has, as a plurality of image forming units (stations), first, second, third and fourth image forming units PY, PM, PC and PK which form a toner image of each of the colors of yellow (Y), magenta (M), cyan (C) and black (K), respectively. Note that, with respect to elements having the same or corresponding functions or configuration among the respective image forming units PY, PM, PC and PK, in some cases the characters Y, M, C and K which are added to the end of the reference characters and which indicate which color the relevant element is used for may be omitted, and the elements collectively described. In the present embodiment, each image forming unit P is formed to include a photosensitive member 1, a charge roller 2, an exposure unit 3, a developing device 4, a primary transfer roller 5 and a cleaning apparatus 6.

A drum-type photosensitive member (photosensitive drum) 1 as an image bearing member that bears a toner image is rotationally driven in the direction of an arrow R1 (clockwise) in FIG. 1. The surface of the rotating photosensitive member 1 is uniformly charged to a predetermined potential having a predetermined polarity (in the present embodiment, a negative polarity) by the charge roller 2 that is a roller-type charge member as a charge unit. The charge roller 2 is disposed in contact with the surface of the photosensitive member 1, and the charge roller 2 rotates to follow the rotation of the photosensitive member 1 when the photosensitive member 1 rotates. At the time of a charging process, a charging voltage of negative polarity is applied from a charging power supply (unshown) to the charge roller 2. The surface of the photosensitive member 1 that was subjected to the charging process is subjected to scanning exposure by a laser beam L based on image information by means of an exposure unit (laser scanner) 3, thereby forming an electrostatic latent image (electrostatic image) on the photosensitive member 1. In the present embodiment, the exposure unit 3 is configured as a single unit (laser optical unit) that exposes the respective photosensitive members 1 of the respective image forming units P. The electrostatic latent image is formed as a result of the exposure unit 3 repeating an operation in which the exposure unit 3 scans and exposes an electrostatic image for each line in a main scanning direction that is substantially parallel to the rotation axis direction of the photosensitive member 1, with respect to a plurality of lines in a sub-scanning direction that is substantially parallel to the direction of movement of the surface of the photosensitive member 1 accompanying rotation of the photosensitive member 1.

The electrostatic latent image that is formed on the photosensitive member 1 is developed (visualized) by toner as developer that is supplied by the developing device 4 as a developing unit, to thereby form a toner image on the photosensitive member 1. The developing device 4 includes a developing roller 41 as a developer bearing member that carries toner to a portion (developing unit) facing the photosensitive member 1, and a developing container 42 that stores toner. Toner of the colors of yellow, magenta, cyan and black is stored in the developing containers 42Y, 42M, 42C and 42K, respectively. At the time of the development process, a developing bias voltage (hereunder, referred to as "developing voltage") having negative polarity whose absolute value is less than the charge potential of the photosensitive member 1 is applied from a developing power supply (unshown) to the developing roller 41. In the present embodiment, toner that was charged with the same polarity (negative polarity in the present embodiment) as the charge polarity of the photosensitive member 1 adheres to the exposed portion on the photosensitive member 1 at which the absolute value of the potential decreased as a result of being exposed after the photosensitive member 1 was uniformly charged. In the present embodiment, the normal charge polarity of the toner that is the charge polarity of the toner at the time of development is a negative polarity.

An intermediate transfer belt 7 as an intermediate transfer member constituted by an endless belt is disposed facing the respective photosensitive members 1Y, 1M, 1C and 1K. The intermediate transfer belt 7 is supported by a drive roller 71, a tension roller 72 and an idler roller 73 as a plurality of stretching rollers. When the drive roller 71 is rotationally driven, the intermediate transfer belt 7 is caused to rotate (circulatingly move) in the direction (counterclockwise) indicated by the arrow R2 in FIG. 1. The respective primary transfer rollers 5 that are roller-type primary transfer members as primary transfer units are disposed on an inner circumferential surface side of the intermediate transfer belt 7 in correspondence with the respective photosensitive members 1. Each primary transfer roller 5 is pressed toward the corresponding photosensitive member 1 with the intermediate transfer belt 7 interposed therebetween to thereby form a primary transfer section (primary transfer nip) T1 at which the photosensitive member 1 and the intermediate transfer belt 7 come in contact. As described above, at the primary transfer section T1, the toner image formed on the photosensitive member 1 is subjected to a primary transfer onto the intermediate transfer belt 7 as a rotating transferred member by means of an electrostatic force and a pressure that are applied by the primary transfer roller 5. At the time of the primary transfer process, a primary transfer voltage that is a direct-current voltage having a reverse polarity (in the present embodiment, a positive polarity) to the normal charge polarity of the toner is applied to the primary transfer roller 5 from a primary transfer power supply (high-voltage power supply circuit) E1 as an application unit. For example, when forming a full-color image, toner images of the respective colors of yellow, magenta, cyan and black that are formed on the respective photosensitive members 1 are transferred sequentially so as to be superposed on each other on the intermediate transfer belt 7.

On the outer circumferential surface side of the intermediate transfer belt 7, a secondary transfer roller 8 that is a roller-type secondary transfer member as a secondary transfer unit is disposed at a position facing the drive roller 71 that also serves as a secondary transfer opposing roller. The secondary transfer roller 8 is pressed toward the drive roller 71 with the intermediate transfer belt 7 interposed therebetween to form a secondary transfer section (secondary transfer nip) T2 where the intermediate transfer belt 7 and the secondary transfer roller 8 come in contact with each other. The toner image that is formed on the intermediate transfer belt 7 as described above is subjected to a secondary transfer at the secondary transfer section T2 onto a transfer material S that is pinched and conveyed between the intermediate transfer belt 7 and the secondary transfer roller 8, by means of an electrostatic force and a pressure that are applied by the secondary transfer roller 8. At the time of the secondary transfer process, a secondary transfer voltage that is a direct-current voltage having a reverse polarity (in the present embodiment, a positive polarity) to the normal charge polarity of the toner is applied to the secondary transfer roller 8 from a secondary transfer power supply (high-voltage power supply circuit) E2. The transfer material (recording material, recording medium, sheet) S such as paper is loaded in a transfer material cassette 11 and is fed by a pick-up roller 12 or the like and conveyed as far as registration rollers 13. After a skew of the transfer material S is corrected by the registration rollers 13, the transfer material S is supplied to the secondary transfer section T2 in a manner that matches the timing of supplying the transfer material S with the timing of the toner image on the intermediate transfer belt 7.

The transfer material S onto which the toner image was transferred is conveyed to a fixing device 9 as a fixing unit. At the fixing device 9, the toner image is fixed (fused and fixed) to the surface of the transfer material S by being heated and pressurized by the fixing device 9. Thereafter, the transfer material S is discharged (output) to outside of an apparatus main body 110 of the image forming apparatus 100.

Residual toner (primary transfer residual toner) remaining on the photosensitive member 1 when the primary transfer process is performed is removed from the surface of the photosensitive member 1 and collected by the cleaning apparatus 6 as a cleaning unit. The cleaning apparatus 6 has a cleaning blade 61 that is disposed in contact with the photosensitive member 1, and a cleaning container 62 that supports the blade 61 and also stores residual toner. The blade 61 is one example of a cleaning member that contacts an image bearing member to remove toner on the image bearing member from the image bearing member. The blade 61 is a tabular (blade-shaped) member formed of rubber (urethane rubber or the like) as an elastic material. The blade 61 is disposed so that the longitudinal direction thereof is substantially parallel to the longitudinal direction (rotation axis direction) of the photosensitive member 1, and an edge part of one end (a free end) in the short-side direction thereof contacts against the surface of the photosensitive member 1. Further, the free end in the short-side direction of the blade 61 is caused to contact against the photosensitive member 1 in a direction (counter direction) in which the free end faces the upstream side in the direction of rotation of the photosensitive member 1. The cleaning apparatus 6 scrapes residual toner from the surface of the rotating photosensitive member 1 by means of the blade 61, and stores the residual toner in the cleaning container 62. Further, residual toner (secondary transfer residual toner) that remains on the intermediate transfer belt 7 at the time of the secondary transfer process is collected by an electrostatic collection method. Cleaning of the intermediate transfer belt 7 is described later.

Figure 2:
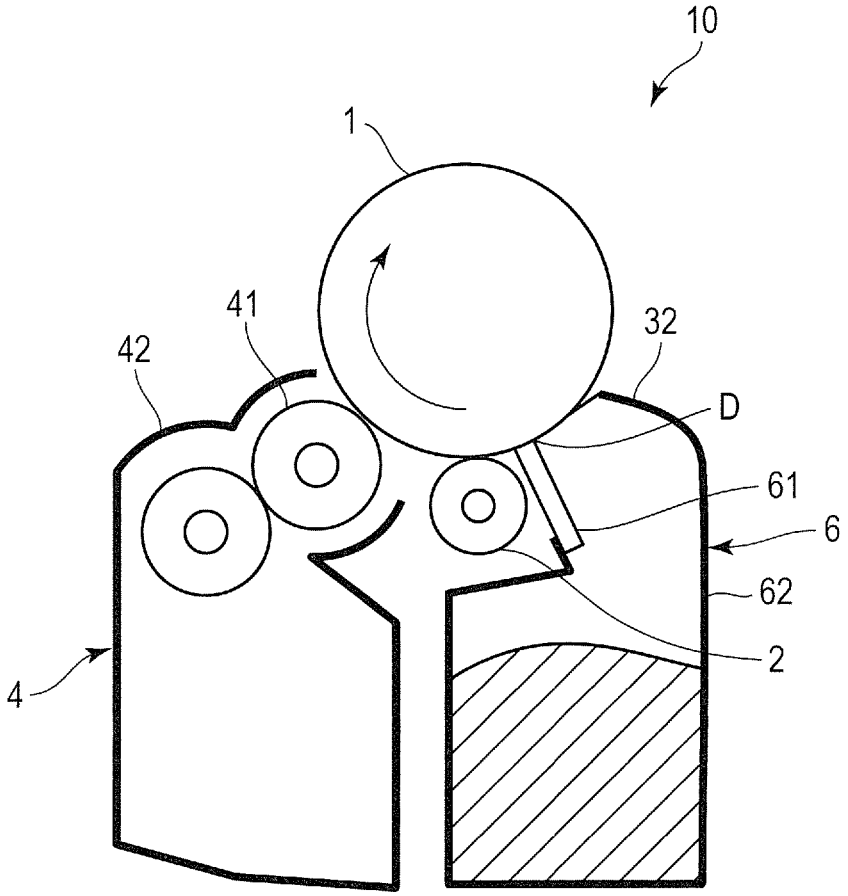
FIG. 2 is a schematic longitudinal sectional drawing of a process cartridge.

In each of the image forming units P, the photosensitive member 1, and the charge roller 2, the developing device 4 and the cleaning apparatus 6 as process units that act on the photosensitive member 1 constitute a cartridge (process cartridge) 10 that is detachably mountable to the apparatus main body 110 in an integral manner. FIG. 2 is a schematic cross-sectional view of the process cartridge 10. In the present embodiment, respective cartridges 10Y, 10M, 10C and 10K are disposed side-by-side inside the apparatus main body 110 in a direction that intersects with the direction of gravity along the movement direction of the intermediate transfer belt 7.

Further, in the present embodiment, the photosensitive member 1 is a member formed by coating an organic photoconductor layer (OPC photosensitive member) onto the outer circumferential face of an aluminum cylinder having a diameter of 30 mm.

Further, in the present embodiment, the intermediate transfer belt 7 is formed of an endless film-like member having a thickness of approximately 50 to 150 μm and a specific volume resistivity of $10^{7}$ to $10^{14}$ Ωcm. The volume resistivity is a value obtained by using a measuring probe conforming to the JIS K6911 method and a high resistance meter R2340 manufactured by ADVANTEST Corp., at a temperature of 25° C., a relative humidity of 50%, and applying a voltage of 50 to 100 V.

Figure 3:
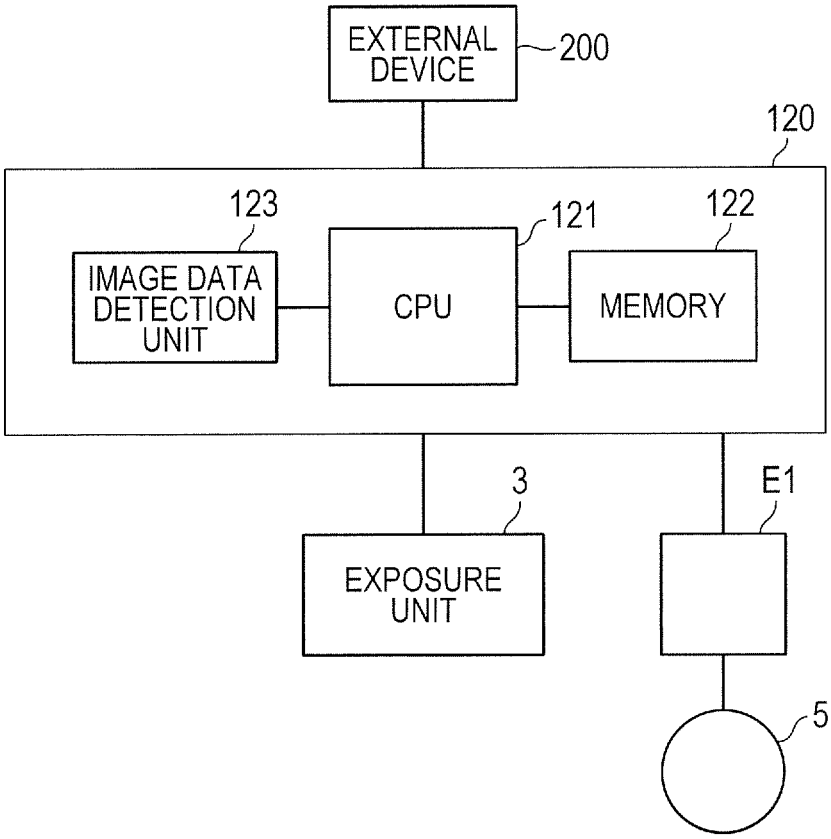
FIG. 3 is a schematic block diagram illustrating a control form in one embodiment.

FIG. 3 is a schematic block diagram illustrating a control form for principal parts of the image forming apparatus 100 of the present embodiment. In the present embodiment the operations of the respective units of the image forming apparatus 100 are subjected to overall control by a control unit (control circuit) 120 provided in the apparatus main body 110. The control unit 120 is configured to include a CPU 121 as a control unit, and a memory 122 constituted by a ROM or a RAM as a memory unit. The control unit 120 controls the respective units of the image forming apparatus 100 by means of the CPU 121 performing processing according to a program or the like stored in the memory 122.

2. Cleaning of Intermediate Transfer Belt

Residual toner that remains on the intermediate transfer belt 7 at the time of the secondary transfer process is charged with a reverse polarity (in the present embodiment, a positive polarity) to the normal charge polarity of the toner by a cleaning brush 15 that is a brush-like toner charge member as a toner charge unit.

In the present embodiment, the cleaning brush 15 is a brush that is formed so that fibers made of electrically conductive nylon having an electrical resistance of $10^{6}$ to $10^{9}$ Ω become substantially compressed. The cleaning brush 15 is disposed so as to contact the intermediate transfer belt 7 at a position that is downstream relative to the secondary transfer section T2 and upstream relative to the primary transfer section T1 (most upstream primary transfer section T1Y) in the direction of rotation of the intermediate transfer belt 7. In the present embodiment, the cleaning brush 15 is fixedly disposed at a position facing the tension roller 72 with the intermediate transfer belt 7 interposed therebetween. The length of the cleaning brush 15 in the longitudinal direction (direction that is substantially orthogonal to the direction of movement of the intermediate transfer belt 7) is greater than the length of an image formation region (region in which a toner image can be formed) on the intermediate transfer belt 7 in the same direction. Further, in the present embodiment, a width in the short-side direction (direction of movement of the intermediate transfer belt 7) of the cleaning brush 15 is 4 mm. The cleaning brush 15 is disposed in a manner so that the cleaning brush 15 is pressed toward the tension roller with the intermediate transfer belt 7 interposed therebetween so that the positions of the tips of the brush fibers penetrate by an amount of 1.0 mm into the surface of the intermediate transfer belt 7. A contact section between the cleaning brush 15 and the intermediate transfer belt 7 is a charging unit CL that charges the residual toner on the intermediate transfer belt 7 by means of the cleaning brush 15.

A configuration is adopted so that a direct-current voltage of +1.0 to +2.0 kV having a reverse polarity to the normal charge polarity of the toner can be applied as a cleaning voltage to the cleaning brush 15 from a cleaning power supply (high-voltage power supply circuit) E3. The cleaning brush 15 is provided in order to charge the residual toner on the intermediate transfer belt 7 to an appropriate charge amount for electrostatically moving (reverse-transferring) the residual toner to the photosensitive member 1 at the primary transfer section T1. The cleaning brush 15 also plays a role of mechanically dispersing the residual toner on the intermediate transfer belt 7 in a substantially uniform manner. In the present embodiment, a direct-current voltage of +1.5 kV is applied to the cleaning brush 15. The residual toner on the intermediate transfer belt 7 that was charged by the cleaning brush 15 is caused to move to the photosensitive member 1Y at the primary transfer section T1Y (for yellow) that is the most upstream primary transfer section in the present embodiment. The residual toner is removed from the surface of the photosensitive member 1Y and collected by the cleaning apparatus 6Y.

3. Calculation of Printing Rate

Next, a method for calculating the printing rate in the present embodiment will be described. Note that, in the present embodiment, the method for calculating the printing rate is substantially the same for the respective image forming units PY, PM, PC and PK, and hence the description here will focus on one image forming unit P.

The control unit 120 receives a print request and image data from an external device 200 such as a PC (personal computer). The CPU 121 of the control unit 120 controls driving of a scanner motor inside the exposure unit 3 so that a BD signal that is an output reference signal that the exposure unit 3 outputs each time a single line is scanned is output at a predetermined timing. Further, each time before forming one image that is to be transferred onto one sheet of the transfer material S and output, an image data detection unit 123 as a detection unit of the control unit 120 clears both of a dot number counter and an on-dot number counter which the image data detection unit 123 includes to 0. Thereafter, each time scanning of one line is performed, the image data detection unit 123 increments the dot number counter at the timing of receiving the BD signal that is the output reference signal. Further, each time image data is "on" during scanning of one line, the image data detection unit 123 increments the on-dot number counter. Furthermore, when scanning of a specified number of lines of one image has been performed, the image data detection unit 123 calculates the printing rate per image as an approximate value by means of the following expression: (on-dot number counter/dot number counter)×100.

4. Control of Primary Transfer Voltage

Next, a method for controlling the primary transfer voltage in the present embodiment is described. Note that, in the present embodiment, the method for controlling the primary transfer voltage is substantially the same for the respective image forming units PY, PM, PC and PK, and hence the description here will focus on one image forming unit P.

When optimizing the transfer voltage by focusing on only the transfer properties, smearing of the charge roller 2 sometimes occurs, particularly in a case where images with a low printing rate are formed in succession. Such smearing of the charge roller 2 is dependent on the primary transfer voltage, and there is a tendency for the smears to worsen as the absolute value of the primary transfer voltage increases, and to improve as the absolute value of the primary transfer voltage decreases.

It is considered that the mechanism by which smearing of the charge roller 2 occurs is as follows. That is, paper powder or external additives released from toner that have a smaller particle size than the toner are present as adhered materials that smear the charge roller 2. Normally, residual toner that has not been transferred onto a transferred member from the photosensitive member 1 is removed from the surface of the photosensitive member 1 and collected by a cleaning member. In a case where the blade 61 is used as a cleaning member, residual toner that was scraped off by the blade 61 stays for a while at an edge part D (space between the end face of the blade and the surface of the photosensitive member or the like) of the blade 61, and thereafter falls freely and is collected in the cleaning container 62. On the other hand, because the size of the adhered material is smaller than the size of the toner, most of the adhered material is liable to elude the blade 61. However, when residual toner is present at the edge part D of the blade 61, the adhered material adheres to the residual toner and stays at the edge part D of the blade 61. That is, in a state in which residual toner is present at the edge part D of the blade 61, the adhered material stays at the edge part D of the blade 61 together with the residual toner, and smearing of the charge roller 2 can be suppressed. However, the residual toner at the edge part D of the blade 61 does not stay as it is at the edge part D of the blade 61, but rather is replaced by newly generated residual toner that is supplied to the edge part D of the blade 61. In a case where formation of images that have a low printing rate is continuously performed and the amount of newly generated residual toner is small, the pressure between particles of residual toner at the edge part D of the blade 61 is reduced and the residual toner falls freely and is collected in the cleaning container 62. Therefore, the amount of residual toner at the edge part D of the blade 61 decreases with the passage of time. Consequently, when formation of images that have a low printing rate is performed continuously, adhered materials are liable to elude the blade 61 and to adhere to the charge roller 2 and smear the charge roller 2.

Note that, because the particle size of adhered materials such as paper powder and external additives is smaller than the particle size of toner, when attempting to collect such adhered materials mechanically by means of the blade 61, it is necessary to cause the blade 61 to contact against the photosensitive member 1 comparatively strongly. In such a case, the torque that causes the photosensitive member 1 to rotate will increase, and the durability of the blade 61 and the photosensitive member 1 will decrease due to heat and abrasion generated by sliding friction between the blade 61 and the photosensitive member 1.

It is considered that the mechanism whereby smearing of the charge roller 2 worsens as the absolute value of the primary transfer voltage increases (mechanism whereby the amount of adhered material that attaches to the charge roller 2 increases) is as follows. That is, when the absolute value of the primary transfer voltage is large, in the primary transfer section T1 and in the vicinity of the downstream side of the primary transfer section T1, the charged charge amount of the adhered material that is adhered on the photosensitive member 1 increases due to electrical discharge. Therefore, a reflection force between the adhered material and the photosensitive member 1 acts strongly. As a result, it becomes difficult to capture the adhered material with the residual toner at the edge part D of the blade 61, and the adhered material is liable to elude the blade 61. For example, in the case of a configuration with a reversal development system in which the charge polarity of the photosensitive member 1 is a negative polarity as in the present embodiment, the primary transfer voltage is a positive polarity, and adhered material that is adhered on the photosensitive member 1 is also charged with a positive polarity. On the other hand, a charging voltage of negative polarity is applied to the charge roller 2, and the adhered material that is adhered on the photosensitive member 1 is liable to electrostatically adsorb on the charge roller 2. Consequently, when the absolute value of the primary transfer voltage is large, the amount of adhered material that adheres on the charge roller 2 increases.

Figure 4A:
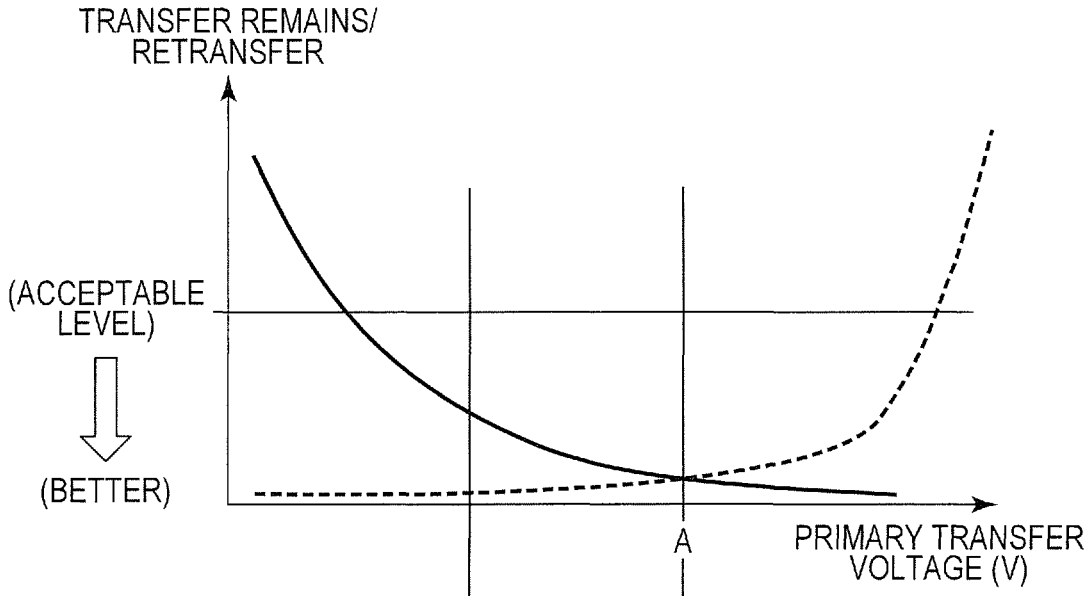
FIG. 4A and FIG. 4B are graphs illustrating the relation between transfer voltage, transfer properties, and smearing of a charge roller.

FIG. 4A is a graph illustrating the relation between the primary transfer voltage, and transfer remains (solid line) and retransfer (dashed line). Here, the term "transfer remains" refers to the amount of toner that remains on the photosensitive member 1 without being transferred onto the intermediate transfer belt 7 when a toner image is transferred from the photosensitive member 1 to the intermediate transfer belt 7, and the lower the value, the better the level of transfer remains which is indicated thereby (the transfer efficiency is good). On the other hand, the term "retransfer" refers to the amount of toner that moves (undergoes a reverse transfer) from the intermediate transfer belt 7 to the photosensitive member 1 when toner on the intermediate transfer belt 7 passes through the contact section between the photosensitive member 1 and the intermediate transfer belt 7, and the lower the value, the better the level of retransfer (the difficulty of occurrence) which is indicated thereby. If transfer remains or retransfer occurs at a level that is higher than the line indicating the acceptable level in FIG. 4A, image defects (transfer failure) may occur in an amount that is greater than the acceptable amount. Based on FIG. 4A it will be understood that although the transfer remains become better as the absolute value of the transfer voltage increases, if the absolute value of the transfer voltage is made excessively large, the retransfer properties deteriorate. The point at which the solid line and the dashed line intersect is an optimal primary transfer voltage A from the viewpoint of transfer remains and retransfer.

Figure 4B:
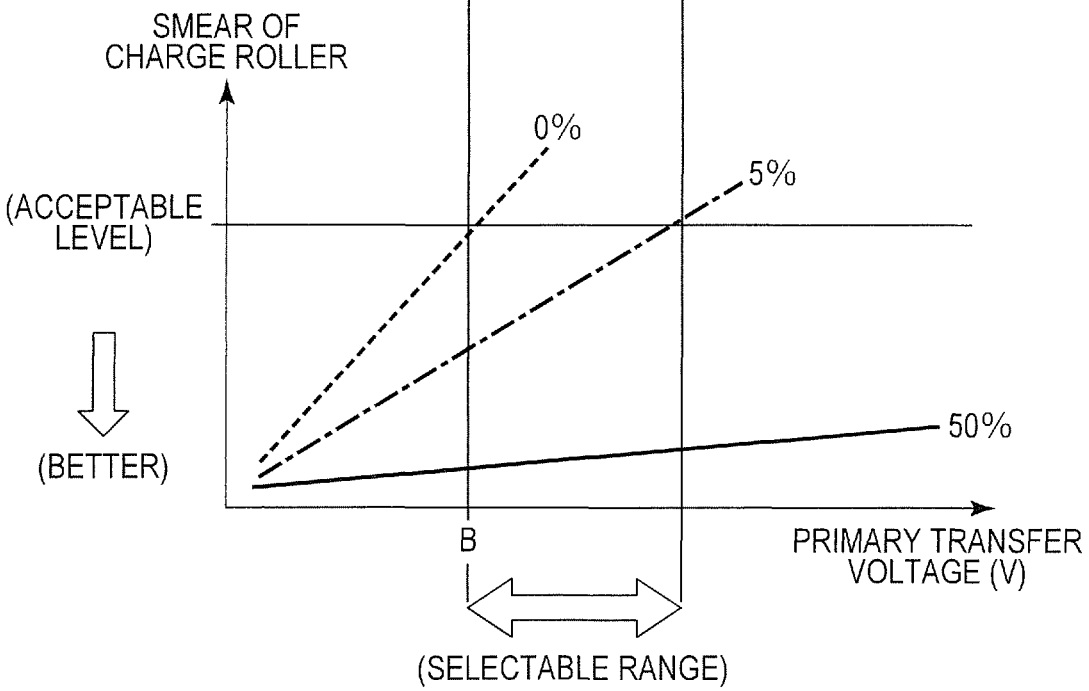

FIG. 4B is a graph illustrating the relation between the primary transfer voltage and smearing of the charge roller 2. Smearing of the charge roller 2 was evaluated by performing an endurance test. The solid line shows the relation between the primary transfer voltage and smearing of the charge roller 2 when images for which the printing rate was 50% were formed consecutively on 10,000 sheets. The dashed line shows the relation between the primary transfer voltage and smearing of the charge roller 2 when images for which the printing rate was 0% were formed consecutively on 10,000 sheets. Further, the alternate long and short dash line shows the relation between the primary transfer voltage and smearing of the charge roller 2 when images for which the printing rate was 5% were formed consecutively on 10,000 sheets. If the charge roller 2 is smeared at a level that is higher than the line indicating the acceptable level in FIG. 4B, image defects may arise due to a charging defect (charging unevenness) of the photosensitive member 1. Based on FIG. 4B, it can be understood that when images for which the printing rate was 50% were formed consecutively, the level of smearing of the charge roller 2 was good regardless of the primary transfer voltage. That is, the slope of a straight line indicating the relation between the transfer voltage and smearing of the charge roller 2 is sufficiently small. In contrast, when images for which the printing rate was 0% were formed consecutively, as the absolute value of the primary transfer voltage increased, smearing of the charge roller 2 noticeably worsened. That is, the slope of a straight line indicating the relation between the transfer voltage and smearing of the charge roller 2 is large to a degree that cannot be ignored. For the case where images for which the printing rate was 5% were formed consecutively, the slope of a straight line indicating the relation between the transfer voltage and smearing of the charge roller 2 is between the slope for the case of the printing rate of 0% and the slope for the case of the printing rate of 50%. Further, the primary transfer voltage when the straight line indicating the relation between the transfer voltage and smearing of the charge roller 2 in the case of the printing rate of 5% and the line indicating the acceptable level intersect is the same value as the optimal primary transfer voltage A (FIG. 4A) from the viewpoint of transfer remains and retransfer.

Thus, in the configuration of the present embodiment, when formation of images for which the printing rate is 5% or more is continuously performed, the primary transfer voltage may be controlled to the optimal primary transfer voltage A from the viewpoint of transfer remains and retransfer. Further, when formation of images for which the printing rate is lower than 5% is continuously performed, in order to suppress the occurrence of smearing of the charge roller 2, the primary transfer voltage can be controlled so as to make the absolute value thereof less than the aforementioned optimal primary transfer voltage A from the viewpoint of transfer remains and retransfer. However, because the transfer properties will decline by an amount greater than an acceptable amount if the absolute value of the primary transfer voltage is made excessively small, the value of the primary transfer voltage can be restricted to a predetermined range (in FIG. 4A and FIG. 4B, a range of values greater than or equal to B and less than or equal to A).

In the present embodiment, the optimal primary transfer voltage from the viewpoint of transfer remains and retransfer is 600 V. Further, in the present embodiment, 20 V is added to the primary transfer voltage (+20 V) each time one high printing rate image (in the present embodiment, an image for which the printing rate is 5% or more) is formed. Further, in the present embodiment, when five low printing rate images (in the present embodiment, an image for which the printing rate is less than 5%) are formed consecutively, 20 V is subtracted from the primary transfer voltage (−20 V), and thereafter 20 V is subtracted from the primary transfer voltage (−20 V) each time one image having a low printing rate is formed. By making the amount of change in the absolute value of the primary transfer voltage each time a predetermined amount in this way, the occurrence of large fluctuations in the transfer properties due to changes in the primary transfer voltage each time image formation is performed can be suppressed, and stabilization of the images that are output can be achieved. However, the minimum value and maximum value of the primary transfer voltage are set to 400 V and 600 V, respectively, and a configuration is adopted so that the primary transfer voltage does not exceed this range. Note that, the range of the primary transfer voltage can be appropriately set to a range that is allowable from the viewpoint of transfer remains and retransfer. For example, a range that is approximately from an absolute value that is smaller by around several hundred V (for example 300 V) than the absolute value of the optimal primary transfer voltage A from the viewpoint of transfer remains and retransfer that is determined as described above to the absolute value of the primary transfer voltage A is a suitable range.

Note that, for simplicity, a case is described here in which the optimal primary transfer voltage A from the viewpoint of transfer remains and retransfer is 600 V. However, a plurality of primary transfer voltages A that depend on, for example, the environment (at least one of the temperature and the humidity) and the usage history (whether at the initial stage or last stage of the life cycle) of the primary transfer roller 5 and the intermediate transfer belt 7 may be set in advance. Further, the primary transfer voltage A may be set depending on a result of acquiring information relating to the electric resistance value of the primary transfer roller 5 or the intermediate transfer belt 7. For example, the following method is available. A voltage that is subjected to constant-current control to a previously set value is applied to the primary transfer roller 5 at a non-image forming time, and the generated voltage at such time is detected. Subsequently, at an image forming time, constant voltage control is performed at the value of the optimal primary transfer voltage A from the viewpoint of transfer remains and retransfer that is determined by means of the detected generated voltage or arithmetic processing or the like that is based on the detected generated voltage. In this case, the non-image forming time when such an operation to set the primary transfer voltage A is performed is a time period other than an image forming time when formation of an electrostatic image of an image to be transferred to the transfer material S and output, formation of a toner image, and primary transfer or secondary transfer of a toner image is performed. Examples of a non-image forming time include a prerotation process that is a time period in which preparatory operations are performed prior to image formation, a sheet interval process that is a time period corresponding to an interval between one transfer material S and a next transfer material S at a time of consecutive image forming that forms an image on a plurality of the transfer materials S, and a post-rotation process that is a time period for performing arrangement (preparation) operations after image formation. Typically, an operation to set the primary transfer voltage A can be performed during the prerotation process when starting each print job (a series of operations which are started by a single start instruction and which form an image on one or a plurality of sheets of the transfer material S and output the resultant sheet(s) of the transfer material S).

Figure 5:
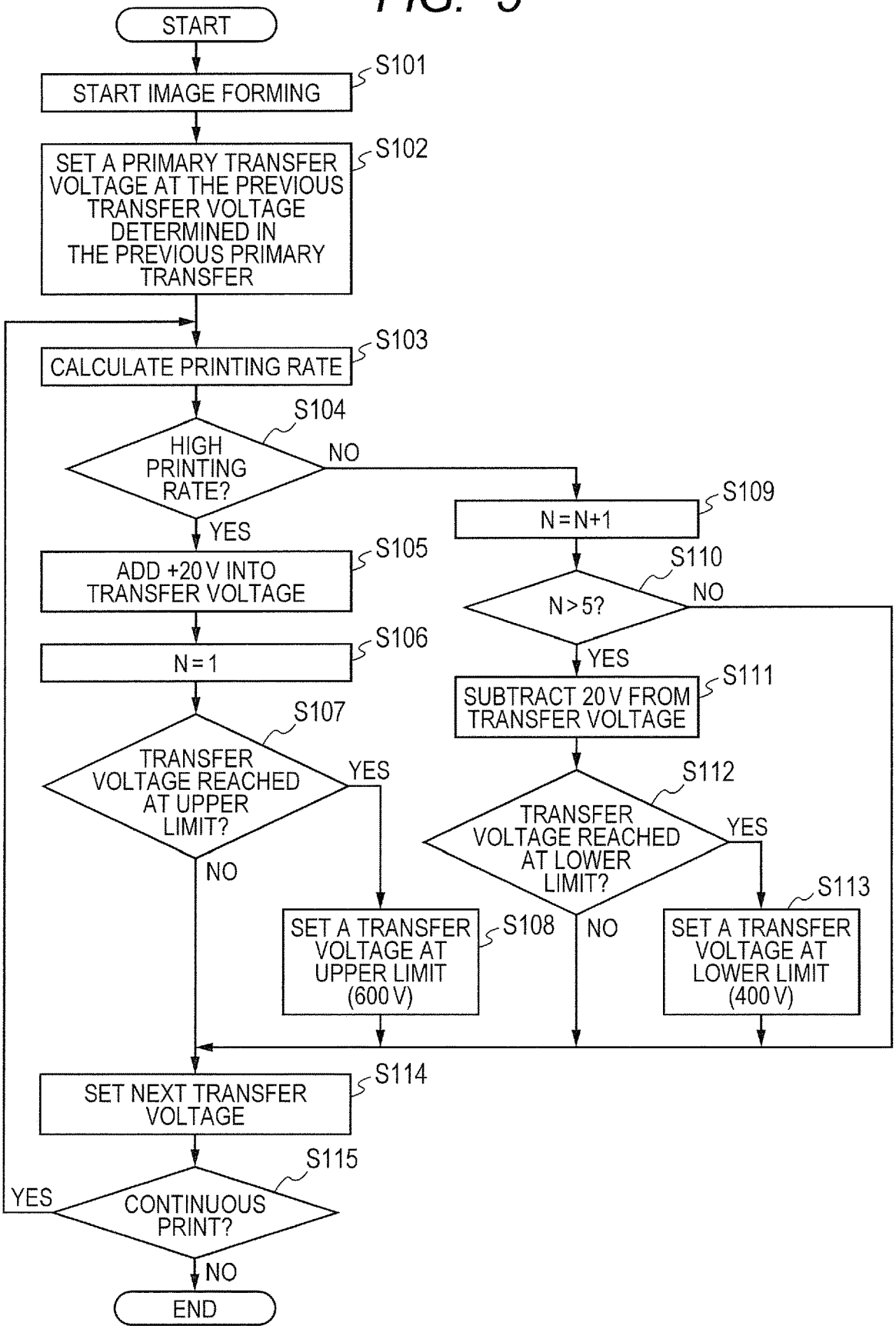
FIG. 5 is a flowchart illustrating steps of transfer voltage control in one embodiment.

FIG. 5 is a flowchart illustrating procedures for controlling the primary transfer voltage during printing in the present embodiment.

The CPU 121 starts the printing operation (S101). The CPU 121 sets the primary transfer voltage as a constant voltage at the value of the primary transfer voltage determined at the time of the previous printing (S102). In this case, if the current printing is printing that is performed immediately after the power of the image forming apparatus 100 was turned on, the CPU 121 sets the primary transfer voltage to 600 V. The CPU 121 acquires a printing rate calculated by the image data detection unit 123 as described above during image formation (S103), and determines whether or not the image being printed is a high printing rate image (whether the printing rate is 5% or more) (S104).

If the CPU 121 determines in S104 that the image is a high printing rate image, the CPU 121 adds 20 V to the primary transfer voltage that is currently set (S105), and sets a variable N (N is an integer with a value of 1 or more) that is stored in the memory 122 to 1 (S106). Further, the CPU 121 determines whether or not the primary transfer voltage exceeds the upper limit value (600 V) (S107), and if the primary transfer voltage exceeds the upper limit value, the CPU 121 re-sets the primary transfer voltage to the upper limit value (600 V) (S108).

On the other hand, if the CPU 121 determines in S104 that the image is a low printing rate image, the CPU 121 adds 1 to the variable N stored in the memory 122 (S109), and determines whether or not the variable N is greater than 5 (whether or not printing of a low printing rate image has been performed consecutively for five or more sheets of the transfer material S) (S110). If the CPU 121 determines in S110 that printing of a low printing rate image has been performed consecutively for five or more sheets of the transfer material S, the CPU 121 subtracts 20 V from the primary transfer voltage that is currently set (S111). Further, the CPU 121 determines whether or not the primary transfer voltage is less than the lower limit value (400 V) (S112), and if the primary transfer voltage is less than the lower limit value the CPU 121 re-sets the primary transfer voltage to the lower limit value (400 V) (S113).

The control unit 120 sets the primary transfer voltage for the next print operation in the manner described above (S114), and if the current operation is a continuous print operation, the control unit 120 returns the processing to S103 (S115).

5. Effects

Next, effects of the present embodiment are described by comparing the present embodiment and a comparative example. In the comparative example, the primary transfer voltage is fixed to 600 V that is optimal from the viewpoint of transfer remains and retransfer. The configuration and operations of the respective image forming apparatuses 100 of the present embodiment and the comparative example are substantially the same with respect to points other than setting of the primary transfer voltage. Image formation on 10,000 sheets was performed for a total of four kinds of operation settings, namely, "low printing", "high printing", "pattern A" and "pattern B" as test images, and smearing and transfer properties of the charge roller 2 were evaluated. In this case, for the "low printing" a test image for which the printing rate was 2% was formed, and for the "high printing" a test image for which the printing rate was 20% was formed. Further, for the "pattern A", five sheets of low printing (printing rate of 2%) and one sheet of high printing (printing rate of 20%) were taken as one set, and continuous image formation was performed in which this pattern was repeatedly printed. Furthermore, for the "pattern B", 20 sheets of low printing (printing rate of 2%) and one sheet of high printing (printing rate of 20%) were taken as one set, and continuous image formation was performed in which this pattern was repeatedly printed. The evaluation results are shown in Table 1. In Table 1, smearing of the charge roller 2 was evaluated as follows: a case where smearing was adequately suppressed is indicated by "good", a case where smearing occurred to a certain extent but the smearing was acceptable from a practical standpoint is indicated by "Δ (slightly inferior)", and a case where smearing occurred at a level that is a problem from a practical standpoint is indicated by "bad". Further, transfer properties were evaluated as follows: a case where a transfer failure did not occur is indicated by "good", and a case where a transfer failure occurred is indicated by "bad".

TABLE 1

| | Smearing of Charge Roller/Transfer Properties | | | |
|---|---|---|---|---|
| | Low Printing | High Printing | Pattern A | Pattern B |
| Present Embodiment | good/good | good/good | good/good | good/good |
| Comparative Example | bad/good | good/good | slightly inferior/good | bad/good |

According to the present embodiment, for each of the operation settings, smearing of the charge roller 2 could be suppressed while suppressing the occurrence of a decline in the transfer properties by an acceptable amount or greater. It is considered that this is because, in the present embodiment, the primary transfer voltage is controlled according to the printing rate in a manner that takes into account the amount of residual toner at the edge part D of the blade 61.

In contrast, according to the comparative example, although no problem arose with regard to transfer properties, smearing of the charge roller 2 occurred for each of the operation settings of low printing, pattern A and pattern B, and in particular the level of smearing of the charge roller 2 was bad for the operation settings of low printing and pattern B. It is considered that this is because, in the comparative example, the primary transfer voltage was fixed at 600 V during formation of low printing rate images also.

Note that, in the present embodiment a configuration is adopted in which 20 V as a predetermined change amount is added to the primary transfer voltage each time one high printing rate image as a predetermined number of high printing rate images (number of images) is formed. Further, in the present embodiment a configuration is adopted in which 20 V as a predetermined change amount is subtracted from the primary transfer voltage in a case where five low printing rate images as a predetermined number of images are continuously formed, and thereafter 20 V is subtracted from the primary transfer voltage each time one low printing rate image is formed. However, the aforementioned predetermined number of images and predetermined change amount are not limited to the values of the present embodiment and can be appropriately set so as to adequately suppress the occurrence of smearing of the charge roller 2. Further, although in the present embodiment one threshold value of the printing rate is set to divide the printing rate range into two ranges which are a high printing rate range and a low printing rate range, a plurality of threshold values may be set, and the printing rate range may be divided into three or more ranges. In this case, when an image is formed that is in one of the printing rate ranges (for example, the range of a middle printing rate in a case where two threshold values are set and the printing rate is divided into three ranges which are a low range, a middle range and a high range), the primary transfer voltage that is currently set may be maintained (neither added to nor subtracted from). Further, in this case, the aforementioned predetermined number of images may be changed for each printing rate range, or the aforementioned predetermined change amount may be changed instead of or in addition to changing the predetermined number of images. For example, in a printing rate range for which the absolute value of the primary transfer voltage is changed in an increase direction, the higher that the printing rate in the range is, the smaller that the aforementioned predetermined number of images can be made, or the larger that the aforementioned predetermined change amount can be made. Further, for example, in a printing rate range for which the absolute value of the primary transfer voltage is changed in a decrease direction, the lower that the printing rate is, the smaller that the aforementioned predetermined number of images can be made, or the larger that the aforementioned predetermined change amount can be made.

Thus, in the present embodiment the image forming apparatus 100 includes the image data detection unit 123 that detects the printing rate as a detection unit that, for each toner image that is transferred onto one transfer material S and output, detects an index value that correlates with the toner amount of the relevant toner image. Further, the image forming apparatus 100 includes the CPU 121 as a control unit that controls the primary transfer power supply E1 as an application unit. The CPU 121 performs control that changes the absolute value of the primary transfer voltage for a toner image to be formed next according to the detection result of the image data detection unit 123. That is, the absolute value of the primary transfer voltage is increased in a case where one toner image for which the printing rate is equal to or greater than a first threshold value is formed or a plurality of such toner images are continuously formed, and is decreased in a case where one toner image for which the printing rate is less than a second threshold value is formed or a plurality of such toner images are continuously formed. As described above, although the second threshold value may be less than or equal to the first threshold value, in the present embodiment the first threshold value and the second threshold value are the same value. Further, in the present embodiment the CPU 121 makes the amount of change per print operation in the absolute value of the primary transfer voltage a predetermined amount. Further, in the present embodiment the CPU 121 performs the aforementioned control so as to change the absolute value of the primary transfer voltage within a predetermined range. That is, in a case where the absolute value of the primary transfer voltage exceeds a predetermined upper limit value during the aforementioned control, the CPU 121 sets the absolute value of the primary transfer voltage for the toner image to be formed next to the upper limit value. Further, in a case where the absolute value of the primary transfer voltage becomes less than a predetermined lower limit value during the aforementioned control, the CPU 121 sets the absolute value of the primary transfer voltage for the toner image to be formed next to the lower limit value. Note that, although in the present embodiment the printing rate is used as an index value that correlates with the toner amount of a toner image, for example, a value of the aforementioned on-dot number counter may be used in a case where the number of dots of the image formation region is constant, or an integrated value of density information of each pixel of an image may be used.

Further, in the present embodiment, in a case where one image for which the printing rate is equal to or greater than a threshold value is formed, the variable N is set to 1 and the absolute value of the primary transfer voltage is changed by a predetermined change amount in the increase direction. Further, in the present embodiment, the variable N is increased by 1 each time one image for which the printing rate is less than the threshold value is formed, and if the variable N becomes greater than 5, the absolute value of the primary transfer voltage is changed by a predetermined change amount in the decrease direction. By this means, the absolute value of the primary transfer voltage can be adequately decreased and smearing of the charge roller 2 can be suppressed by utilizing comparatively simple control. In contrast, the following control may be performed in a case where the degree to which smearing of the charge roller 2 occurs changes relatively sensitively depending on the printing rate. For example, the variable N is increased or decreased depending on the printing rate, such as by adding 1 to the variable N in a case where an image for which the printing rate is equal to or greater than a threshold value is formed, and by subtracting 1 from the variable N in a case where an image for which the printing rate is less than the relevant threshold value is formed, and the resulting variables N are sequentially stored. Further, the absolute value of the primary transfer voltage at the time of the next print operation is increased or decreased by an amount that depends on the current variable N from the absolute value of the optimal primary transfer voltage A from the viewpoint of transfer remains and retransfer. In this case also, the primary transfer voltage can be changed within a predetermined range.

For example, when taking the minimum value of the primary transfer voltage as 400 V and taking the maximum value thereof as 600 V, the value of the primary transfer voltage in this range is changed in increments/decrements of 10 V which are made to correspond with integers from 1 to 21 for the variable N, respectively. In this case, for example, when formation of images for which the printing rate is equal to or greater than a threshold value is continuously performed, and application of the optimal primary transfer voltage A from the viewpoint of transfer remains and retransfer is continued, the variable N is set to 21 that is the maximum value. Thereafter, when one image for which the printing rate is less than the threshold value is formed and the variable N becomes 20, the primary transfer voltage at the time of the next print operation is made 590 V which is obtained after subtracting 10 V from the aforementioned primary transfer voltage A, and when a further one image is formed, the primary transfer voltage at the time of the next print operation is made 580 V in a similar manner. Conversely, for example, in a case where formation of images for which the printing rate is less than the threshold value continues and application of a primary transfer voltage of 400 V that is the minimum value is continued, the variable N is set to 1 that is the minimum value. Thereafter, when one image for which the printing rate is equal to or greater than the threshold value is formed and the variable N becomes 2, the primary transfer voltage at the time of the next print operation is made 410 V which is obtained by adding 10 V to the aforementioned minimum value, and when a further one image is formed, the primary transfer voltage is made 420 V in a similar manner. Note that, high and low with respect to the printing rate and the increase and decrease directions for the variable are not limited to those described in the foregoing, and the relation may be the opposite to that described above. Further, even in the case of performing the above control, a configuration may be adopted in which, similarly to the configuration mentioned above, a plurality of threshold values are provided, and in a case where an image that is in one of the printing rate ranges is formed, the current variable N may be maintained (neither added to nor subtracted from).

Thus, the image forming apparatus 100 may include a memory unit (memory 122) that revises the variable N according to the printing rate as an index value that correlates with the toner amount of a toner image, and stores the revised variable N. The memory unit is configured to change the variable N in a first direction that is one of the increase direction and the decrease direction in a case where the printing rate is equal to or greater than the first threshold value, and to store the changed variable N. Further, the memory unit is configured to change the variable N in a second direction that is opposite to the first direction among the increase direction and the decrease direction in a case where the printing rate is less than the second threshold value that is equal to or less than the first threshold value, and to store the changed variable N. Further, the control unit (CPU 121) can perform control that changes, according to the variable N, the absolute value of the primary transfer voltage for a toner image to be formed next. That is, the absolute value of the primary transfer voltage is increased in a case where the variable N is changed in the aforementioned first direction, and is decreased in a case where the variable N is changed in the aforementioned second direction. In this case also, the absolute value of the primary transfer voltage can be made to change within a predetermined range.

As described above, according to the present embodiment, smearing of the charge roller 2 can be suppressed while suppressing a decline in the transfer properties by an acceptable amount or greater.

Embodiment 2

Next, another embodiment of the present invention will be described. The fundamental configuration and operations of the image forming apparatus of the present embodiment are the same as in Embodiment 1. Accordingly, components in the image forming apparatus of the present embodiment that have the same or corresponding functions or configurations as components of the image forming apparatus of Embodiment 1 are denoted by the same reference characters as in Embodiment 1 and a detailed description of such components is omitted hereunder.

In the present embodiment, the control that changes the primary transfer voltage according to the printing rate which is described in Embodiment 1 is performed only under a predetermined environment in which smearing of the charge roller 2 is liable to occur. That is, under a low-temperature and low-humidity environment, because adhered materials such as paper powder and external additives of toner on the photosensitive member 1 are liable to be strongly charged to a positive polarity, the adhered materials are liable to elude the blade 61. Therefore, it can be said that smearing of the charge roller 2 is particularly liable to occur in a case where formation of low printing rate images is continued under a low-temperature and low-humidity environment. Therefore, in the present embodiment a configuration is adopted so as to suppress smearing of the charge roller 2 that is liable to arise, in particular, under a low-temperature and low-humidity environment.

Figure 6:
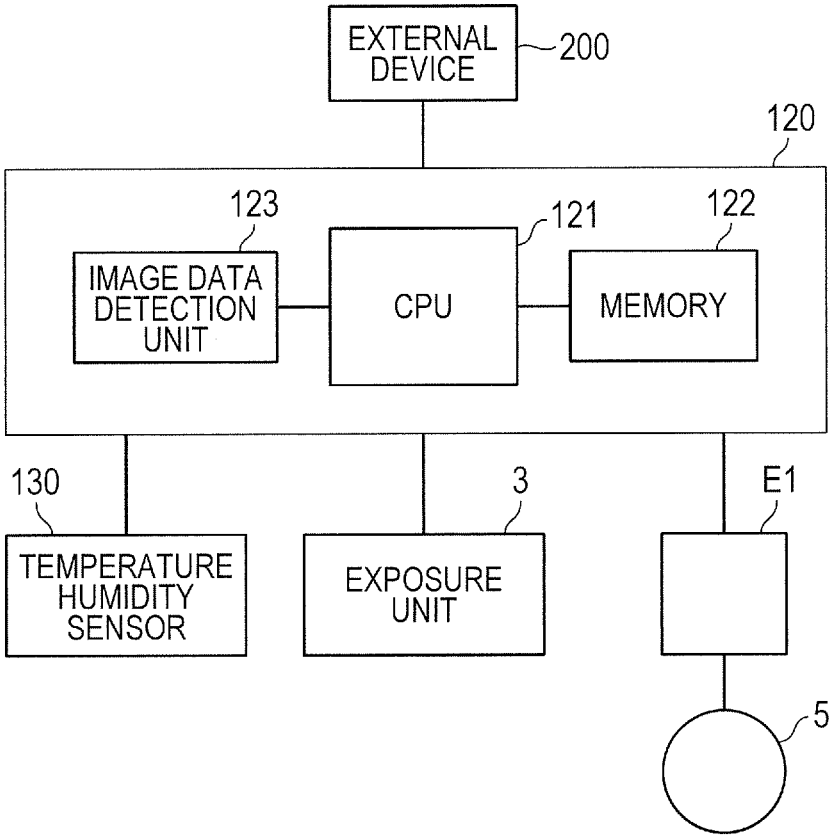
FIG. 6 is a schematic block diagram illustrating a control form in another embodiment.

FIG. 6 is a functional block diagram illustrating a control form for principal parts of the image forming apparatus 100 of the present embodiment. In the present embodiment, the image forming apparatus 100 includes an environment detection unit that detects at least one of the temperature and humidity of at least one of the interior and exterior of the apparatus main body 110. In the present embodiment a temperature humidity sensor 130 that detects the temperature and humidity of the ambient environment (exterior of the apparatus main body 110) in which the image forming apparatus 100 is being used is provided as the environment detection unit. At an arbitrary timing, the CPU 121 of the control unit 120 can acquire information regarding the temperature and humidity of the ambient environment in which the image forming apparatus 100 is being used that is detected by the temperature humidity sensor 130. If the CPU 121 determines that the environment is a low-temperature and low-humidity environment in which the detected temperature is lower than a predetermined temperature that is set in advance, and the detected humidity is lower than a predetermined humidity that is set in advance, the CPU 121 performs control that changes the primary transfer voltage according to the printing rate in a similar manner as in Embodiment 1.

Figure 7:
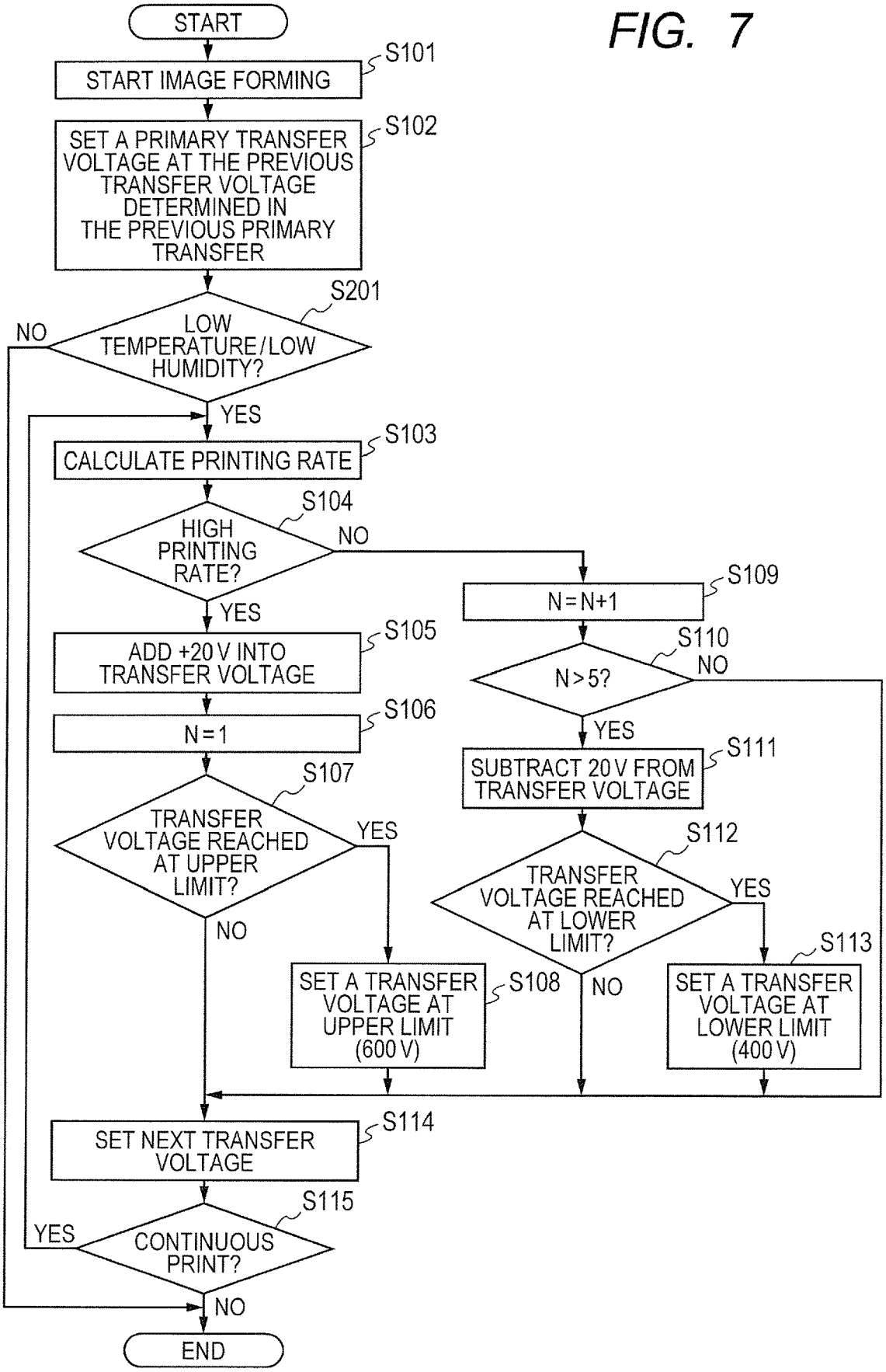
FIG. 7 is a flowchart illustrating steps of transfer voltage control in another embodiment.

FIG. 7 is a flowchart illustrating procedures for controlling the primary transfer voltage during printing in the present embodiment. The processing in S101 to S115 in the flowchart in FIG. 7 is the same as the processing in the same step numbers (S101 to S115) in the flowchart in FIG. 5 described in Embodiment 1. The processing in the present embodiment differs from the processing in Embodiment 1 in the respect that processing in S201 is added between the processing in S102 and the processing in S103.

That is, in the present embodiment, after the processing in S102, the CPU 121 acquires information regarding the temperature and humidity that is detected by the temperature humidity sensor 130, and determines whether or not the environment is a low-temperature and low-humidity environment (S201). Specifically, in the present embodiment the CPU 121 determines that the environment is a low-temperature and low-humidity environment in a case where the environment is one in which the temperature is 15° C. or less and the relative humidity is 30% or less, in which smearing of the charge roller 2 is liable to occur. If it is determined in S201 that the environment is a low-temperature and low-humidity environment, the CPU 121 advances the processing to S103 and thereafter performs similar control as in Embodiment 1. On the other hand, if the CPU 121 determines in S201 that the environment is not a low-temperature and low-humidity environment, the CPU 121 does not perform control that changes the primary transfer voltage according to the printing rate, and instead sets the primary transfer voltage to the optimal primary transfer voltage A from the viewpoint of transfer remains and retransfer that is set in advance, and causes image formation to be performed.

Thus, in the present embodiment, the image forming apparatus 100 includes the temperature humidity sensor 130 as an environment detection unit that detects the environment, and depending on the detection result of the temperature humidity sensor 130, the CPU 121 determines whether or not to perform control that changes the primary transfer voltage according to the printing rate. Although in the present embodiment the temperature and humidity are detected as the environment, the degree of occurrence of smearing of the charge roller 2 may sometimes have a sufficient correlation with at least one of temperature and humidity. Typically, the CPU 121 can perform control that changes the primary transfer voltage according to the printing rate in a case where at least one condition among a condition that a temperature indicated by a detection result of the environment detection unit is equal to or less than a predetermined temperature and a condition that a humidity indicated by the detection result is equal to or less than a predetermined humidity is satisfied.

As described above, according to the present embodiment, by adopting a configuration so that control of the primary transfer voltage according to the printing rate is performed only in an environment in which smearing of the charge roller 2 is liable to occur, similar effects as in Embodiment 1 are obtained, and the simplification of control can be achieved.

Embodiment 3

Next, another embodiment of the present invention will be described. The fundamental configuration and operations of the image forming apparatus of the present embodiment are the same as in Embodiment 1. Accordingly, components in the image forming apparatus of the present embodiment that have the same or corresponding functions or configurations as components of the image forming apparatus of Embodiment 1 are denoted by the same reference characters as in Embodiment 1 and a detailed description of such components is omitted hereunder.

In the present embodiment, the image formation region is divided into a plurality of regions in the main scanning direction, and control of the primary transfer voltage is performed based on the printing rates in the respective regions. That is, although in Embodiment 1 the primary transfer voltage is controlled according to a printing rate determined for each image transferred onto one sheet of the transfer material S and output, there are cases where the printing rate is not uniform over the whole area of the image region for a single image. For example, in some cases, even when an approximate value (average value) of the printing rate with respect to a single image is equal to or greater than a predetermined value (for example, 5%), the printing rate with respect to a specific region in the main scanning direction is less than the predetermined value (for example, 5%). In such a case, the amount of residual toner that stays at the edge part of the blade 61 in the specific region in the main scanning direction may decrease, and adhered material may easily adhere to the charge roller 2 at a position corresponding to that region. Therefore, in the present embodiment, the printing rate is determined for each of a plurality of regions in the main scanning direction of the image formation region, and the primary transfer voltage is controlled in a manner that is adapted to the region with the lowest printing rate.

In the present embodiment, the image formation region is divided into a plurality of regions (also referred to herein as "divided regions") that each have a width of 10 mm in the main scanning direction. The reason for making the width of each divided region (length in the main scanning direction) a width of 10 mm in the present embodiment is as follows. That is, because residual toner at the edge part D of the blade 61 spreads out in the main scanning direction to a certain extent, in the present embodiment there is no necessity to divide the image formation region more minutely than this. On the other hand, if the number of divisions with respect to the divided regions is too large (if the width of each divided region is too small), there is a concern that adverse effects may arise such as a memory capacity of a corresponding amount being required, and an increase in the cost of the image forming apparatus 100 and the like. Therefore, in the present embodiment the width of each divided region is made 10 mm width as the required minimum width. However, the width is not limited to the value in the present embodiment, and can be appropriately set so as to enable adequate suppression of smearing of the charge roller 2.

A method for calculating the printing rate in each divided region according to the present embodiment will now be described. Each time before forming one image that is to be transferred onto one sheet of the transfer material S and output, the image data detection unit 123 of the control unit 120 clears both the dot number counter and the on-dot number counter which the image data detection unit 123 includes to 0. Thereafter, each time a BD signal is received, the image data detection unit 123 resets a BD starting point timer to 0 and causes the operation to start. In the present embodiment, the dot number counter and the on-dot number counter are respectively provided for each divided region in the main scanning direction. Here, an nth (n is an integer equal to or greater than 1) dot number counter and an nth on-dot number counter from one end side in the main scanning direction are taken as a dot number counter n and an on-dot number counter n, respectively. Further, with respect to the positions of the respective divided regions obtained by dividing the image formation region in the main scanning direction into m (m is an integer equal to or greater than 2) regions, the number that a divided region is among the plurality of divided regions is determined by means of the BD starting point timer.

In the present embodiment, when scanning of one line is performed, the image data detection unit 123 increments the dot number counter n of the corresponding mth divided region each time image data is monitored for the respective divided regions. Further, the image data detection unit 123 increments the on-dot number counter n of the corresponding divided region m each time that image data is "on" when image data of the respective divided regions is monitored. Furthermore, when scanning of a specified number of lines of one image has been performed, the image data detection unit 123 calculates the printing rate of the respective divided regions from the first to the mth divided region by means of the following expression: (on-dot number counter n/dot number counter n)×100.

Next, a method for controlling the primary transfer voltage in the present embodiment will be described. In the present embodiment, the CPU 121 determines the primary transfer voltage by the same control as in Embodiment 1 with respect to each divided region. The CPU 121 then selects the lowest primary transfer voltage among the primary transfer voltages determined for the respective divided regions in the main scanning direction, and sets the selected primary transfer voltage as the primary transfer voltage to be used for the next print operation.

Thus, in the present embodiment, the image data detection unit 123 detects a printing rate in each of a plurality of regions in a direction that is substantially orthogonal to the direction of movement of the surface of the photosensitive member 1. The CPU 121 then determines the primary transfer voltage whose absolute value is smallest among primary transfer voltages determined by performing the same control as in Embodiment 1 for each of the plurality of regions, and sets the thus-determined primary transfer voltage as the primary transfer voltage for the next toner image.

As described above, according to the present embodiment, by dividing the image formation region into a plurality of regions in the main scanning direction, and controlling the primary transfer voltage in a manner that is adapted to the region in which smearing of the charge roller 2 is most liable to occur, the occurrence of smearing of the charge roller 2 can be more reliably suppressed.

Note that, the control of the present embodiment may be combined with a determination regarding whether or not to execute control of the primary transfer voltage depending on the printing rate based on the result of detecting the environment that is described in Embodiment 2.

[Others]

Although the present invention has been described by referring to specific embodiments, the present invention is not limited to the above described embodiments.

Although in the foregoing embodiments the image forming apparatus is described as intermediate transfer-type image forming apparatus that includes an intermediate transfer member, the present invention is not limited thereto. A direct transfer-type image forming apparatus that, instead of an intermediate transfer member, includes, for example, an endless belt-type transfer belt as a transfer material bearing member that bears and conveys a transfer material is well known in the field. In the aforementioned image forming apparatus, toner images formed on photosensitive members of respective image forming units are transferred onto a transfer material as a transferred member on the transfer material bearing member by, for example, application of a transfer voltage to transfer members such as transfer rollers disposed on the inner circumferential face side of the transfer material bearing member in correspondence with the respective photosensitive members. Control of the transfer voltage in such kind of image forming apparatus can be performed in a similar manner to the control of the primary transfer voltage in the foregoing embodiments, and the same effects as in the foregoing embodiments are obtained. Furthermore, the present invention can also be applied to an image forming apparatus that includes only one image forming unit, such as an image forming apparatus for the single color black. In such kind of image forming apparatus, for example, by application of a transfer voltage to a transfer member such as a transfer roller that is disposed in contact against a photosensitive member, a toner image formed on the photosensitive member is transferred onto a transfer material as a transferred member that is pinched between the photosensitive member and the transfer member and conveyed thereby. Further, control of the transfer voltage in such kind of image forming apparatus can be performed in a similar manner to the control of the primary transfer voltage in the foregoing embodiments, and the same effects as in the foregoing embodiments are obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-041005, filed Mar. 3, 2017, which is hereby incorporated by reference herein in its entirety.

What is claimed is:

1. An image forming apparatus comprising:

an image bearing member configured to bear a toner image;

a charge member configured to contact the image bearing member and charge the image bearing member;

a transfer unit configured to transfer a toner image to be transferred from the image bearing member to an intermediate transfer member;

an application unit configured to apply to the transfer unit a transfer voltage for transferring a toner image from the image bearing member to the intermediate transfer member;

a cleaning member configured to contact the image bearing member and remove toner on the image bearing member from the image bearing member;

a detection unit configured to detect an index value which correlates with a toner amount of each of toner images transferred to one sheet of a transfer material; and a control unit configured to perform control of a first transfer voltage value to transfer a toner image from the image bearing member to the intermediate transfer member, wherein when an index value of a toner image formed on a first transfer material conveyed just before a second transfer material is equal to or greater than a first threshold value, the control unit increases a transfer voltage so that an absolute value of the transfer voltage to transfer a toner image to be formed on the second transfer material from the image bearing member to the intermediate transfer member is greater than an absolute value of the transfer voltage to transfer a toner image to be formed on the first transfer material from the image bearing member to the intermediate transfer member, wherein after the absolute value of the transfer voltage is increased to an increased value based on the index value of the toner image formed on the first transfer material, in a case where a state in which an index value of a toner image formed on the second transfer material or a transfer material conveyed after the second transfer material is less than a second threshold value does not continue for a predetermined number of times, the control unit maintains the transfer voltage at the increased value, and in a case where the state in which an index value of a toner image formed on the second transfer material or a transfer material conveyed after the second transfer material is less than a second threshold value continues for the predetermined number of times, the control unit decreases the absolute value of the transfer voltage from the increased value, and wherein the second threshold value is equal to or less than the first threshold value, and the predetermined number is greater than one.

2. The image forming apparatus according to claim 1, wherein the control by the control unit includes change of the absolute value of the transfer voltage within a predetermined range.

3. The image forming apparatus according to claim 1, wherein in a case where the absolute value of the transfer voltage in the control exceeds a predetermined upper limit value, the control unit sets the absolute value of the transfer voltage to the upper limit value, and in a case where the absolute value of the transfer voltage in the control is less than a predetermined lower limit value, the control unit sets the absolute value of the transfer voltage to the lower limit value.

4. The image forming apparatus according to claim 1, further comprising an environment detection unit configured to detect environmental conditions, wherein the control unit determines whether or not to perform the control depending on a detection result of the environment detection unit.

5. The image forming apparatus according to claim 4, wherein the control unit performs the control in a case where at least one condition among a condition that a temperature indicated by the detection result is equal to or less than a predetermined temperature and a condition that a humidity indicated by the detection result is equal to or less than a predetermined humidity is satisfied.

6. The image forming apparatus according to claim 1, wherein the detection unit performs detection of the index value in each of a plurality of regions in a direction that is substantially orthogonal to a direction of movement of a surface of the image bearing member, and the control unit obtains transfer voltages for the each of the plurality of the regions based on the index value and determines a transfer voltage whose absolute value is lowest among the transfer voltages for the each of the plurality of the regions as the transfer voltage.

7. The image forming apparatus according to claim 1, wherein the first threshold value is equal to the second threshold value.

8. The image forming apparatus according to claim 1, wherein the index value includes a printing rate.

9. The image forming apparatus according to claim 1, wherein in a time period in which a toner image is not transferred onto the intermediate transfer member from the image bearing member, other than an image forming time, the control unit performs a voltage determination control to determine a transfer voltage based on a voltage applied to the transfer unit from the application unit to flow a current with a predetermined value to the transfer unit, and wherein a value of the first transfer voltage to transfer a toner image to be formed on the first transfer material from the image bearing member to the intermediate transfer member is obtained by the voltage determination control.

10. The image forming apparatus according to claim 1, wherein in a time period in which a toner image is not transferred onto the intermediate transfer member from the image bearing member, other than an image forming time, the control unit performs a voltage determination control to determine a transfer voltage based on a voltage applied to the transfer unit from the application unit to flow a current with a predetermined value to the transfer unit, wherein a value of the transfer voltage to transfer a toner image to be formed on the transfer material from the image bearing member to the intermediate transfer member is obtained based on values obtained by the voltage determination control and a detection result detected by the detection unit.

11. An image forming apparatus comprising:

an image bearing member configured to bear a toner image;

a charge member configured to contact the image bearing member and charge the image bearing member;

a transfer unit configured to transfer a toner image to be transferred from the image bearing member to a transfer medium;

an application unit configured to apply to the transfer unit a transfer voltage for transferring a toner image from the image bearing member to the transfer medium;

a cleaning member configured to contact the image bearing member and remove toner on the image bearing member from the image bearing member;

a detection unit configured to detect an index value which correlates with a toner amount of each of toner images transferred to one sheet of the transfer medium; and a control unit configured to perform control of a transfer voltage value to transfer a toner image from the image bearing member to the transfer medium, wherein when an index value of a toner image formed on a first transfer medium conveyed just before a second transfer medium is equal to or greater than a first threshold value, the control unit increases a transfer voltage so that an absolute value of the transfer voltage to transfer a toner image to be formed on the second transfer medium from the image bearing member to the second transfer medium is greater than an absolute value of the transfer voltage to transfer a toner image to be formed on the first transfer medium from the image bearing member to the first transfer medium, wherein after the absolute value of the transfer voltage is increased to an increased value based on the index value of the toner image formed on the first transfer medium, in a case where a state in which an index value of a toner image formed on the second transfer medium or a transfer medium conveyed after the second transfer medium is less than a second threshold value does not continue for a predetermined number of times, the control unit maintains the transfer voltage at the increased value, and in a case where the state in which an index value of a toner image formed on the second transfer medium or a transfer medium conveyed after the second transfer medium is less than a second threshold value continues for the predetermined number of times, the control unit decreases a value of the transfer voltage from the increased value, and wherein the second threshold value is equal to or less than the first threshold value, and the predetermined number is greater than one.

12. The image forming apparatus according to claim 11, wherein the control by the control unit includes change of the absolute value of the transfer voltage within a predetermined range.

13. The image forming apparatus according to claim 11, wherein in a case where the absolute value of the transfer voltage in the control exceeds a predetermined upper limit value, the control unit sets the absolute value of the transfer voltage to the upper limit value, and in a case where the absolute value of the transfer voltage in the control is less than a predetermined lower limit value, the control unit sets the absolute value of the transfer voltage to the lower limit value.

14. The image forming apparatus according to claim 11, further comprising an environment detection unit configured to detect environmental conditions, wherein the control unit determines whether or not to perform the control depending on a detection result of the environment detection unit.

15. The image forming apparatus according to claim 14, wherein the control unit performs the control in a case where at least one condition among a condition that a temperature indicated by the detection result is equal to or less than a predetermined temperature and a condition that a humidity indicated by the detection result is equal to or less than a predetermined humidity is satisfied.

16. The image forming apparatus according to claim 11, wherein the detection unit performs detection of the index value in each of a plurality of regions in a direction that is substantially orthogonal to a direction of movement of a surface of the image bearing member, and the control unit obtains transfer voltages for the each of the plurality of the regions based on the index value and determines a transfer voltage whose absolute value is lowest among the transfer voltages for the each of the plurality of the regions as the transfer voltage.

17. The image forming apparatus according to claim 11, wherein the first threshold value is equal to the second threshold value.

18. The image forming apparatus according to claim 11, wherein the index value includes a printing rate.

19. The image forming apparatus according to claim 11, wherein in a time period in which a toner image is not transferred onto the transfer medium from the image bearing member, other than an image forming time, the control unit performs a voltage determination control to determine the transfer voltage based on a voltage applied to the transfer unit from the application unit to flow a current with a predetermined value to the transfer unit, and wherein the absolute value of the transfer voltage to transfer a toner image to be formed on the first transfer medium from the image bearing member to the first transfer medium is obtained by the voltage determination control.

20. The image forming apparatus according to claim 11, wherein in a time period in which a toner image is not transferred onto the transfer medium from the image bearing member, other than an image forming time, the control unit performs a voltage determination control to determine the transfer voltage based on a voltage applied to the transfer unit from the application unit to flow a current with a predetermined value to the transfer unit, wherein the absolute value of the transfer voltage to transfer a toner image to be formed on the first transfer medium from the image bearing member to the first transfer medium is obtained based on values obtained by the voltage determination control and a detection result detected by the detection unit.

* * * * *